United States Patent [19]

Pawlowski et al.

[11] 4,170,325

[45] Oct. 9, 1979

[54] RECEPTACLE

[75] Inventors: Thomas D. Pawlowski, Neenah; George L. Meyers, Menasha, both of Wis.

[73] Assignee: American Can Company, Greenwich, Conn.

[21] Appl. No.: 917,367

[22] Filed: Jun. 20, 1978

[51] Int. Cl.[2] ..... B65D 5/72

[52] U.S. Cl. ..... 229/17 B; 221/194; 221/312 R; 312/60

[58] Field of Search ..... 229/17 B; 221/194, 311, 221/312 R, 312 C; 312/60, 61, 71; 206/620

[56] References Cited

U.S. PATENT DOCUMENTS

| | | | |
|---|---|---|---|
| 1,186,705 | 6/1916 | Swift | 229/17 |
| 1,281,271 | 10/1918 | Baldwin | 312/60 |
| 1,973,237 | 9/1934 | Vilas | 229/17 |
| 2,226,626 | 12/1940 | Mann | 312/71 |
| 3,156,378 | 11/1964 | Bua | 221/311 |
| 3,204,762 | 9/1965 | Shanok et al. | 229/17 B |
| 3,300,115 | 1/1967 | Schaver | 229/17 B |
| 3,352,614 | 11/1967 | Andersen | 312/42 |

FOREIGN PATENT DOCUMENTS

| | | | |
|---|---|---|---|
| 318714 | 10/1902 | France | 312/60 |

*Primary Examiner*—Stephen P. Garbe

*Attorney, Agent, or Firm*—Robert P. Auber; Ira S. Dorman; Harry W. Hargis, III

[57] ABSTRACT

A dispensing carton for relatively flat, rectangular articles comprises elongate side walls of generally rectangular disposition closed by end walls. Dimensions of the side walls are such that the articles in stacked array assume an angular disposition in the carton. An endmost article is presented at and partially protrudes through a dispensing slot provided in a side wall of the carton. Removal of the article through the slot permits the succeeding adjacent article to drop and tilt into position partially protruding through the slot.

6 Claims, 3 Drawing Figures

RECEPTACLE

BACKGROUND OF THE INVENTION

This invention relates to receptacles, and especially to receptacles such as cartons for storing and dispensing articles of relatively flat, substantially rectangular shape.

In the packaging of tea bags, for example, it has been found desirable to place the bags in pouches of the aforesaid shape, and then pack the pouches in a carton within which they are stored as they are used. Since the bags and their pouches are of such light weight, conventional dispensing cartons require holding with one hand while grasping the pouch with the other to remove it through a provided slot. Such a two-handed operation can be inconvenient, however, in restaurants or the like.

The following is a listing of prior art, all U.S. Patents, believed material to the examination of this application, together with a concise explanation of the relevance of each:

U.S. Pat. No. 1,186,705 discloses a dispensing cabinet 12 for a weighted stack of angularly disposed cups 16 which are capable of being dispensed frontally through an opening provided in a lower, bevelled end portion of the cabinet.

U.S. Pat. No. 1,973,237 discloses a carton 70 for dispensing individual wafer-like objects 73 from a stack, through an opening 71 and over a partially opened flap 72. The illustrated angular disposition of objects 73 does not contribute to automatic presentation of the objects through the opening.

U.S. Pat. No. 2,226,626 discloses a compartmented casing 10, each compartment storing a weighted stack of crackers to be dispensed through an opening 17 with the aid of curved metal guide strips 13.

U.S. Pat. No. 3,352,614 discloses a column 20 for storing stacked matchbooks and dispensing same through a slot 30 defined in part by a restraining lip 28 on a lower, angularly disposed wall of the column.

It is a general objective of the present invention to provide an improved dispensing receptacle featured by its economy of construction and its effectiveness of operation.

It is a further and more specific objective of the invention to provide an improved dispensing receptacle for stacked angularly disposed articles, and to utilize such angularity to effect pivotation of the lowermost article partially through an opening to accommodate dispensing of the article by a minimum of applied force.

It is a still further objective to provide an improved dispensing receptacle of simple construction.

SUMMARY OF THE INVENTION

In achievement of the foregoing as well as other objectives and advantages, the invention contemplates apparatus for storing and dispensing a stack of articles of generally rectangular shape, comprising a receptacle of a generally rectangular cross-sectional area less than the area of said articles, characterized by being of a dimension corresponding substantially to the dimension of said articles in one direction and of a dimension less than the dimension of the articles in the other direction, whereby a stack of such articles may rest with angularity about a lower first edge of said article, the first edge of each of said articles engaging walls of said receptacle adjacent thereto, and the lower first edge of the endmost article about which it is angularly disposed engaging also an end of said receptacle and the under surface of an adjacent overlying article, and means defining a slot in a wall of said receptacle through which the upper second edge of said angularly disposed endmost article may project, said last recited article being removable through said slot to accommodate presentation of the recited adjacent overlying article at said slot, as it moves downwardly and pivots about its lower disposed first edge.

The manner in which the foregoing as well as other general objectives and advantages of the invention may best be achieved will be more fully understood from a consideration of the following description, taken in light of the accompanying drawing.

DESCRIPTION OF THE PREFERRED EMBODIMENT

Figure 1:
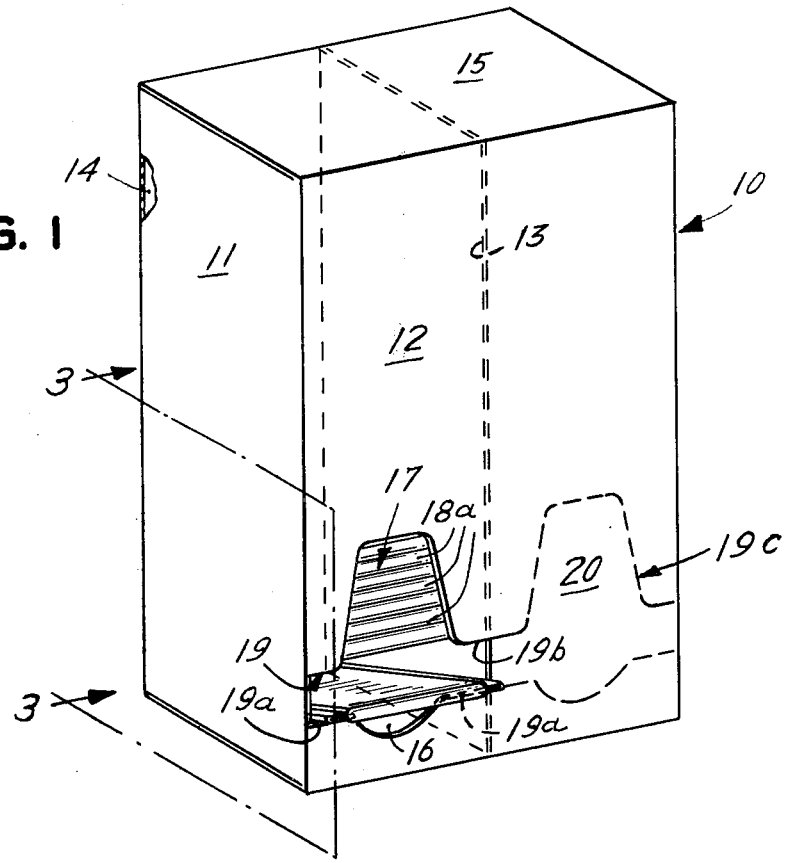
FIG. 1 is a perspective showing of a dispensing receptacle embodying the invention, including articles of a type which may be stored and dispensed.
Figure 3:
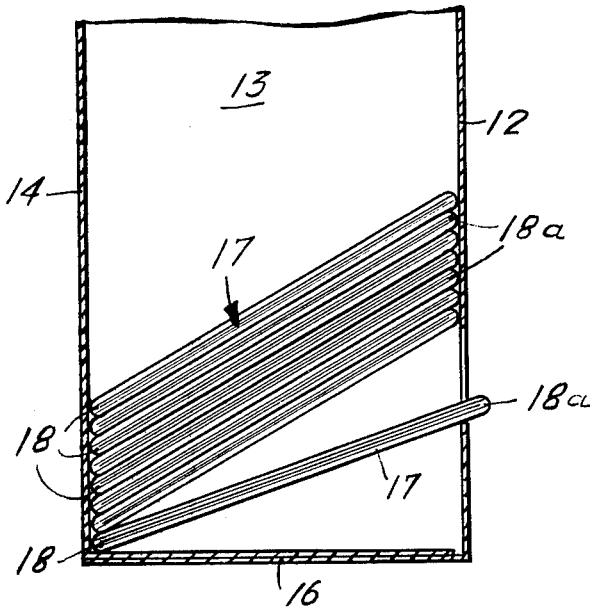
FIG. 3 is an enlarged sectional showing of a portion of the receptacle shown in FIG. 1, taken in the plane of lines 3—3 and looking in the direction of arrows applied thereto.
Figure 2:
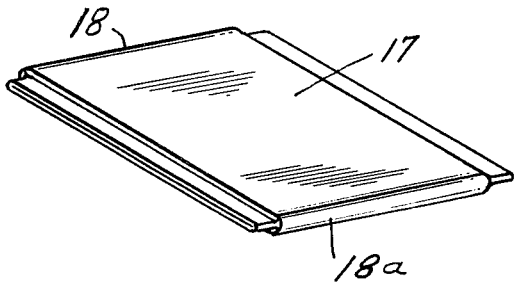
FIG. 2 is an enlarged perspective showing of the article which may be stored in and dispensed from the receptacle shown in FIG. 1.

With more detailed reference to the drawing, and first to FIGS. 1 and 2, a receptacle comprising a carton 10 of generally rectangular cross-sectional shape, and conveniently formed of a paperboard blank, has a pair of like compartments, each also of generally rectangular cross-sectional shape and defined by elongate side walls 11, 12, 13 and 14 in combination with end walls 15 and 16 extending transversely thereof. For convenience of disclosure, only the left-hand compartment will be described in detail. A stack of articles 17 of generally rectangular shape, such as, for example, paper pouches that contain tea bags, are stacked in a compartment, in the upright position of the carton. The cross-sectional area of a compartment is less than that of an article 17, being so dimensionally proportioned that it is essentially the dimension of the article in one direction, and is less than the dimension of the article in the other direction. By virtue of such relative dimensions, and with reference also to FIG. 3, disposition of the stack of articles 17 is such that each article rests with angularity about a first, lower edge 18, as respects side walls 12 and 14, respectively. First and second edges **18, 18*a* of each article 17 engage the correspondingly adjacent regions of walls 12 and 14 of the compartment. First, lower edge 18 of the lower, endmost article 17 engages also the lower end wall 16**.

A slot 19 is provided in a lower region of side wall 12 and through which the second, upper edge **18*a* of the endmost article 17 projects to rest upon horizontally extending lower end portions 19*a* of the slot that are disposed above the bottom wall a distance greater than the thickness of an article. Central upper and lower edges of the slot are notched as shown to facilitate viewing and grasping articles 17**.

It will be understood, of course, that initially the slot 19 may be covered by a removable tab, as shown at 20 on the front wall of the right hand compartment, and held in place in a suitable manner, such as, for example, along a cut score line 19c. Alternatively, the slot may be preformed and covered by a carton overwrap.

The upper horizontally extending end portions 19b of slot 19 are positioned below the next successive angularly stored article 17 a distance corresponding substantially to the thickness of an article. The construction and arrangement is such that removal of the endmost article 17 through slot 19, as is achieved by grasping the second, upper edge 18a thereof projecting through the slot and pulling same, accommodates presentation of the adjacent overlying article 17 at slot 19, as the article moves downwardly, gravitationally, to position in which first, lower edge 18 engages end wall 16, and pivots about this same edge to move the second, upper short edge 18a downwardly past upper end portions 19b for presentation through the slot to engage the lower end portions 19a thereof.

Importantly, the slot is so dimensioned and positioned as respects the thicknesses of articles 17 that an article resting on an adjacent, endmost article presented through the slot will have its second, upper short edge 18a engaging side wall 12 in a region just above the slot, ensuring one-at-a-time dispensing of the articles. Ease of article removal further is enhanced due to substantially sole interengagement between the article presented for dispensing and the overlying article comprising essentially a line contact between the first, lower edge 18 of the dispensed article and the under surface of the adjacent overlying article.

While a preferred embodiment of the invention has been described, it will be understood that changes in form and materials may be resorted to without departing from the scope of the appended claims.

We claim:

1. A package comprising an elongated receptacle adapted for vertical disposition, and a stack of relatively thin articles contained therewithin comprising at least a lower bottommost article and an overlying article, said receptacle being comprised of sidewall portions defining a vertical passageway through which said articles may descend, a bottom wall portion providing underlying support for said stack of articles, and a dispensing opening proximate said bottom wall portion for dispensing said articles, the distance between two opposite sidewall portions of said receptacle being less than a width dimension of said articles with said articles positioned so that said width dimension extends between said two sidewall portions, so as to slantingly dispose said articles within said passageway with a leading edge of at least said overlying article lying against one of said opposite sidewall portions and with the opposite edge thereof lying therebelow against the other of said opposite sidewall portions, the upper edge of said opening being in said one opposite sidewall portion, said opening being dimensioned and configured to permit one of said articles to pass laterally therethrough, at least a portion of the upper edge of said opening being spaced below the leading edge of said overlying article a distance no more than substantially the thickness of said articles, said one sidewall portion being free of obstructions near said upper edge on the interior of said carton whereby removal of said bottommost article will permit said overlying article to descend, said leading edge thereof passing below said upper marginal portion of said opening and thereby to project therethrough, for facile removal.

2. The package of claim 1 comprising multiple receptacle compartments and multiple stacks of articles contained therein.

3. The package of claim 1 wherein said articles are pouches.

4. The package of claim 1 wherein said leading and opposite edges of said articles span a short dimension thereof.

5. The package of claim 1 wherein said opening has a lower edge spaced from said edge portion a distance sufficient that the facing elements of said bottommost article and said overlying article form an acute angle at said other opposite sidewall portion, and the recited engagement of the opposite edge of said bottommost article and the under surface of said overlying article is the sole engagement therebetween as said bottommost article is removed.

6. The package of claim 1 wherein said upper and lower edge defining said opening are notched to facilitate viewing and grasping said articles.

* * * * *